US005449298A

United States Patent [19]

Fetterolf, Sr. James R. et al.

[11] Patent Number: 5,449,298

[45] Date of Patent: Sep. 12, 1995

[54] LATCHING SYSTEM FOR INTERMATABLE CONNECTORS

[75] Inventors: Fetterolf, Sr. James R., Mechanicsburg; Harold W. Kerlin, Port Royal; Jason M. Reisinger, Carlisle, all of Pa.

[73] Assignee: The Whitaker Corporation, Wilmington, Del.

[21] Appl. No.: 269,423

[22] Filed: Jun. 30, 1994

[51] Int. Cl.[6] ..... H01R 13/627

[52] U.S. Cl. ..... 439/352; 439/350

[58] Field of Search ..... 439/350, 351, 352, 353, 439/354, 355, 356, 357, 358

[56] References Cited

U.S. PATENT DOCUMENTS

| | | | |
|---|---|---|---|
| 2,626,975 | 1/1953 | Rockwell et al. | 439/350 |
| 3,711,816 | 1/1973 | Schumacher | 439/352 |
| 4,698,717 | 10/1987 | Scheid | 439/371 |
| 4,726,783 | 2/1988 | Nakazawa et al. | 439/350 |
| 4,798,542 | 1/1989 | Asick et al. | 439/188 |
| 5,011,424 | 4/1991 | Simmons | 439/352 |
| 5,088,932 | 2/1992 | Nakamura | 439/350 |
| 5,090,916 | 2/1992 | Magnier | 439/352 |
| 5,199,897 | 4/1993 | Hashiguchi | 439/357 |
| 5,234,357 | 8/1993 | Yamaguchi | 439/357 |
| 5,295,854 | 3/1994 | Olson | 439/350 |
| 5,314,347 | 5/1994 | Colleran et al. | 439/350 |

*Primary Examiner*—Larry I. Schwartz

*Assistant Examiner*—Hien D. Vu

*Attorney, Agent, or Firm*—William B. Noll

[57] ABSTRACT

This invention relates to a latching system for a pair of intermatable electrical connectors, such as a plug and receptacle, which incorporates a mechanism for unlatching same by the application of a maximum predetermined separating force, such as may be the result of an accident, to the plug and receptacle. The system comprises a first electrical connector having a pair of flexible arms projecting axially therefrom, where the free ends of the arms include slot means for engaging complementary arms within the second electrical connector. The second electrical connector includes a forward ramp surface against which the flexible arms initially ride to effect mating of the connectors, a rearward surface slightly angled, i.e. on the order of about 4° to 10°, from a base toward the ramp surface, and a metal spring arm mounted within the second electrical connector in close proximity to the base of the rearward surface. In the mated condition the spring arm engages the slot means. While a manually operated mechanism is provided to effect unmating, a safety system is included to prevent damage due to forces being applied thereto. For example, to effect unmating a maximum predetermined separating force may be applied therebetween causing the spring arm to flex to a position near the rearward surface at a critical release angle to thereby release the free end from its respective spring arm.

9 Claims, 3 Drawing Sheets

LATCHING SYSTEM FOR INTERMATABLE CONNECTORS

BACKGROUND OF THE INVENTION

This invention is directed to a latching system for a pair of intermatable connectors, such as a receptacle and plug as may be used in a cellular phone system, where separation of the connectors may be accomplished by the application of a maximum predetermined separating force therebetween.

Conventional latching mechanisms for intermatable connectors employ a pair of externally accessible, manually depressible, pivotal members to effect unmating of the connectors. Typically, by manually squeezing such members, the members are laterally moved allowing for the physical separation of the connectors, see U.S. Pat. No. 4,726,783.

U.S. Pat. No. 5,314,347, a more current patent, is another connector latching mechanism that requires operator activation. The mechanism thereof has the disadvantage that the connectors cannot be suitably separated until the operator or user activates the levers of the mechanism. However, there may be situations where separation is desirable without manually activating a latching mechanism. For example, excessive force applied deliberately or by accident, may cause damage or destruction of the connectors' internal mechanism before the latching mechanism is overcome. U.S. Pat. No. 5,199,897 teaches a locking mechanism for connectors, such as a plug and receptacle, that allows separation without manipulating the locking mechanism.

U.S. Pat. No. 5,295,854 teaches a passive latch system for matable connector housings. Each connector housings has at least one working surface depressed from the reference surface thereof to form part of a latching aperture while the other of the housings has at least one working surface raised from the reference surface thereof to form part of a latching projection. The working surface on one of the housings is sloped with respect to its reference surface, and the sloped working surface also is tapered in a direction that is generally parallel with respect to the latching direction.

U.S. Pat. No. 5,011,424, assigned to the assignee hereof, teaches a connector system where pulling on the mated connectors alone disengages one connector from the other. This is achieved by a connector system in which there is a connector having an inner body section and an outer housing section, the inner body section having two latch arms operatively hinged to the connector. The connector has forward of its hinge, a latch arm having latching surfaces at its forward end which latch the connector to a complementary connector. The connector has rearward of the hinge, rotatable actuation arms. The connector is characterized in that the rotatable actuation arms including on the ends, actuator sections having a forwardly directed surface, while the housing includes a rearwardly facing camming surface disposed proximate to the forwardly facing surface, and in that the housing is axially moveable relative to the inner body causing the camming surface to rotate the latch arms about the hinge, thereby unlatching the connector from the complementary connector.

The present invention avoids the complexities of the latching mechanisms of the prior art by a simple, yet precise system, that allows for the separation of a pair of mated connectors at a predetermined level of separating force applied thereto. The manner by which this is accomplished will become apparent from the further description, particularly when read in conjunction with the accompanying drawings.

SUMMARY OF THE INVENTION

This invention relates to a latching system for a pair of intermatable electrical connectors, such as a plug and receptacle, where the connectors are in a latching relationship during periods of operability, and may be unlatched by exerting a maximum predetermined separating force therebetween. The system comprises a first connector having a pair of flexible arms projecting axially therefrom, where the free ends of the arms include slot means for engaging complementary arms within the second connector. The second connector includes a forward ramp surface against which the flexible arms initially ride to effect mating of the connectors, a rearward surface slightly angled from a base toward the ramp surface, and a metal spring arm mounted within the second electrical connector in close proximity to the base of the rearward surface. In the mated condition the spring arm engages the slot means, where the angular relationship of the respective engaging arms is 90°. To effect a non deliberate unmating, such as by accident, a maximum predetermined separating force is applied therebetween causing the spring arm to flex to a position near the rearward surface at a critical release angle to thereby release the free end from its respective spring arm. In a preferred system, for an applied force of about 10 lbs, the critical release angle is about 5°.

DETAILED DESCRIPTION OF PREFERRED EMBODIMENT

Figure 1:
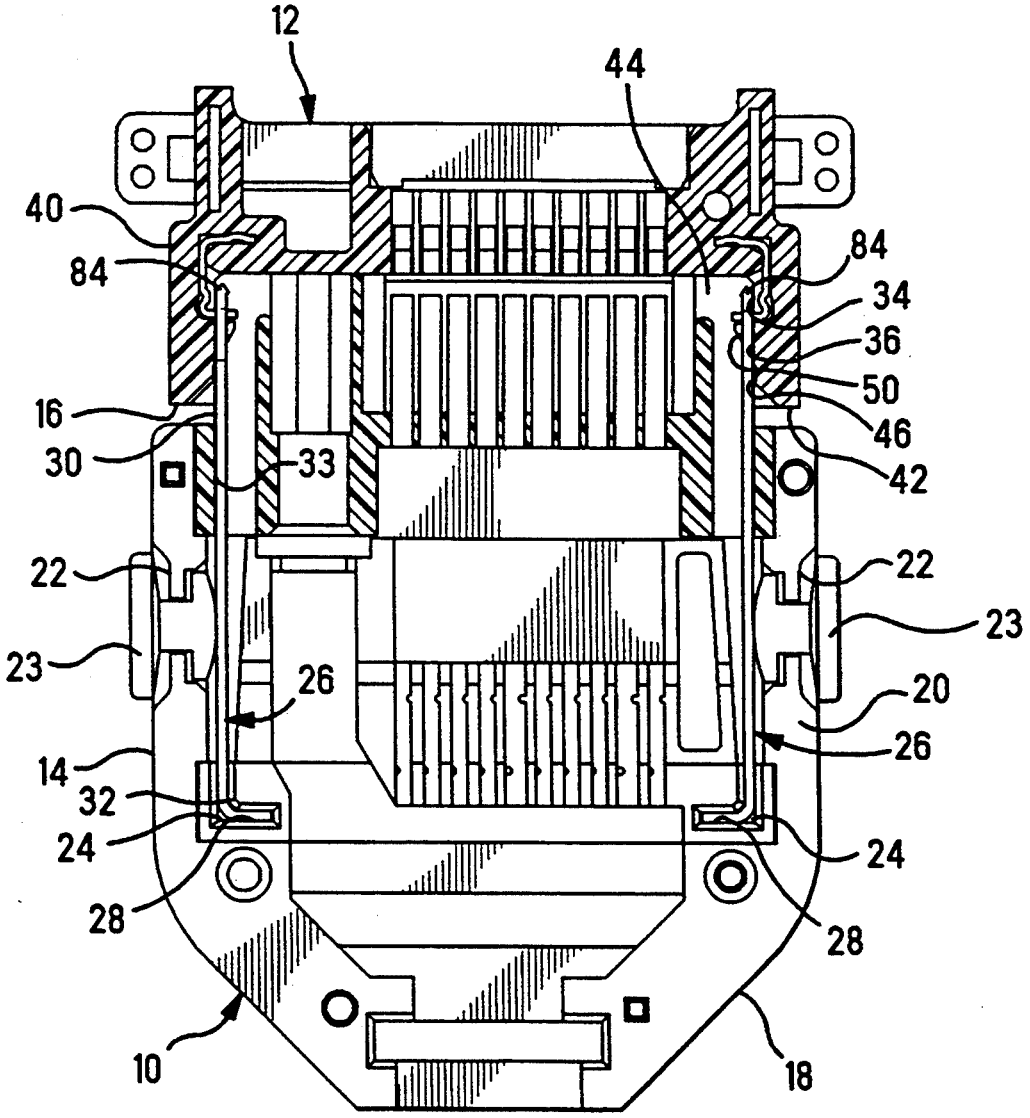
FIG. 1 is a full horizontal sectional view through a pair of mated electrical connectors, such as a plug and receptacle, utilizing the latching system according to this invention.

The present invention is directed to a latching system for a pair of intermatable electrical connectors, such as a receptacle and plug for a cellular telephone, where separation of the plug from the receptacle may be accomplished manually, or by the application of a predetermined separating force applied therebetween, such as may be experienced with an accident. In electrical systems of the type contemplated herein, it can be desirable to ensure a latching system that is operable to maintain electrical or signal contact, while being able to release upon the application of a predetermined pulling force, whether deliberate or by accident, to avoid damage to the contacts or other internal features of the connectors.

Turning now to the several figures, a preferred embodiment of the invention is illustrated in a horizontal section of two mated electrical connectors, such as a plug 10 and a receptacle 12. While the preferred invention hereof is for a cellular telephone system, it will be understood that other matable connectors may likewise utilize the latching system as defined hereinafter. For convenience, and without intending to limit the scope of this invention, the further description will be directed to the intermating of a receptacle and plug for a cellular telephone system. The plug 10 comprises a generally rectangular body portion 14, formed of a dielectric material, such as plastic, having a mating face 16 at one end thereof, and a tapered body portion 18 through which plural conductors, electrical and/or signal, are passed to be terminated to contacts therein, as known in the art. For stability and design integrity, the side walls 20 are relatively thick and may include external depressions 22 for access to a pair of operator activated buttons 23 to effect a planned unmating thereof in a manner to be described hereinafter.

Internally, a pair of L-shaped slots or grooves 24 are provided to receive an elongated metal latching arm 26, where said arm is secured by press fitting the short extension 28 in slot 24. The long remaining arm portions 30, which extend in an axial direction through the mating face and into the receptacle 12, are free to flex or pivot about the junction 32 of the extension 28 and arm portion 30. While a number of metals may be used for the latching arm 26, a preferred selection is a Type 301 stainless steel, tempered to a $\frac{3}{4}$ hardness. Further, to ensure a proper flexing action, the latching arm 26, typically stamped from a flat metal blank, is initially formed a slight amount, i.e. about 4°, along a transverse line near the junction 32 so that in the assembled position the arm 26 lies against the housing wall 33. Finally, at the free end 34 of the arm portion 30 there is provided an elongated slot means 36, the purpose of which will become apparent hereinafter.

The complementary connector, or receptacle 12 of the preferred embodiment, comprises a housing 40, typically molded of a dielectric material, such as plastic, having a mating face 42, a through cavity 44, and related electrical hardware, such as electrical/signal contacts and an antenna connection, as known in the art. Along each side wall 46, facing the cavity 44, is an angled projection 50, see FIG. 4. The projection 50 includes a forward ramp surface 52 against which the arm portion 30 rides upon mating of the connectors. Rearwardly of the projection 50 is a slightly angled wall or surface 54, preferably angled from 4° to 10° from the plane of the longitudinal axis, which surface, as noted later, functions as a stop to the spring arm 60. At the base 56 of the angled surface 54, a recess 58 is provided. This recess, as will become apparent in the further description, provides relief in the flexing of the metal spring arm 60, as hereinafter defined.

Figure 2:
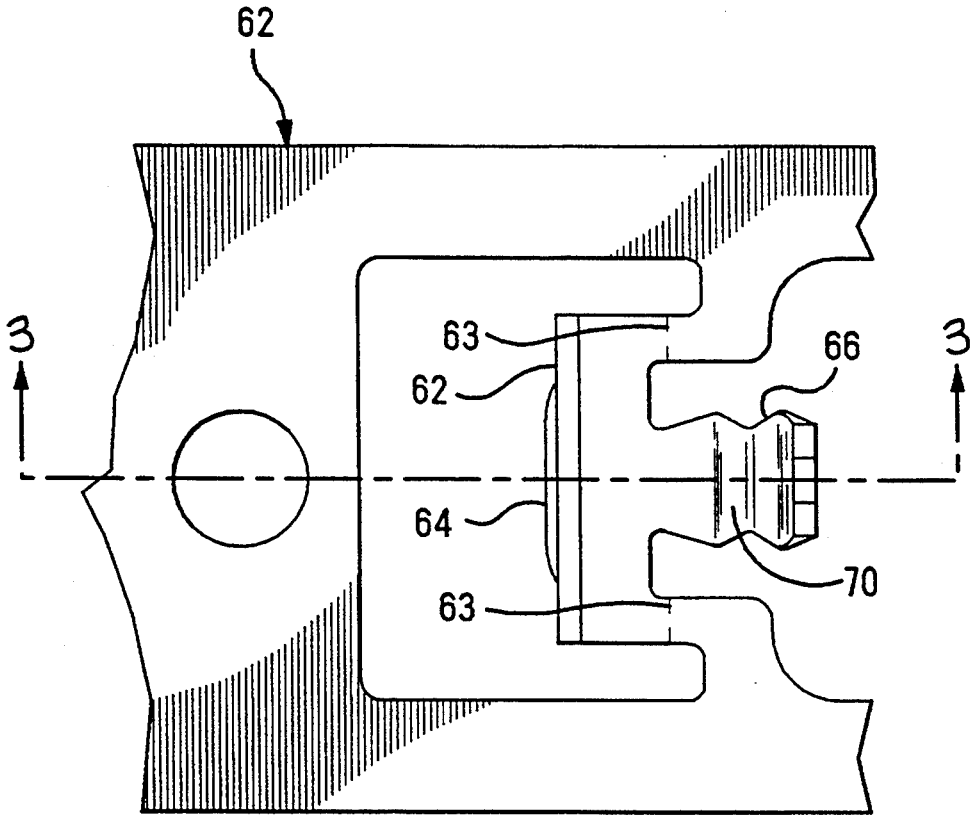
FIG. 2 is a plan view of a stamped and formed metal spring arm to be mounted in the receptacle, for example, where such spring arm is still joined to a removable carrier strip.
Figure 3:
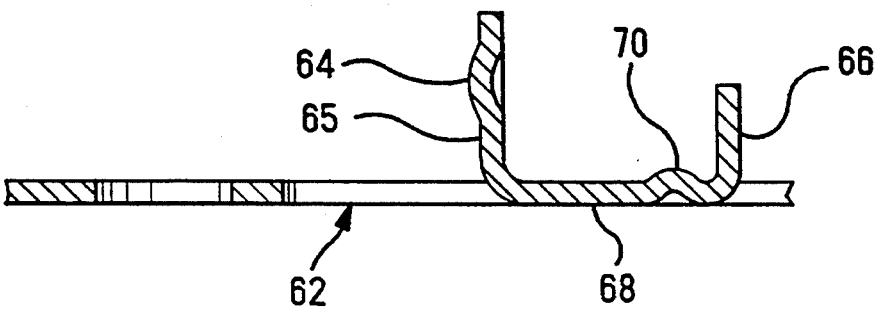
FIG. 3 is a sectional view taken along line 3—3 of FIG. 2.

The metal spring arm 60, formed of a tempered metal, such as beryllium-copper, is stamped and formed from a sheet metal blank 62 (see FIG. 2), preferably into the U-shaped configuration illustrated in FIG. 3, then severed along the cut lines 63 from the carrier strip. While a number of metals may be suitable, a preferred alloy is Berylco Alloy No. 25 (UNS No. C17200) manufactured by NGK Metals Corporation, Reading, Pa. The spring arm 60 is stamped from tempered sheet stock, formed and heat-treated to $\frac{1}{4}$ HT. In any case, the metal spring arm 60 includes a first leg 65, having an internal reverse bend portion 64, a second leg 66, narrower in width to first leg 65, and intermediate leg 68 joining the respective outer legs 65, 66. The intermediate leg 68 is also provided with a reverse bend portion 70, where such portion is positioned to lie adjacent the recess 58, for reasons to be explained.

Figure 4:
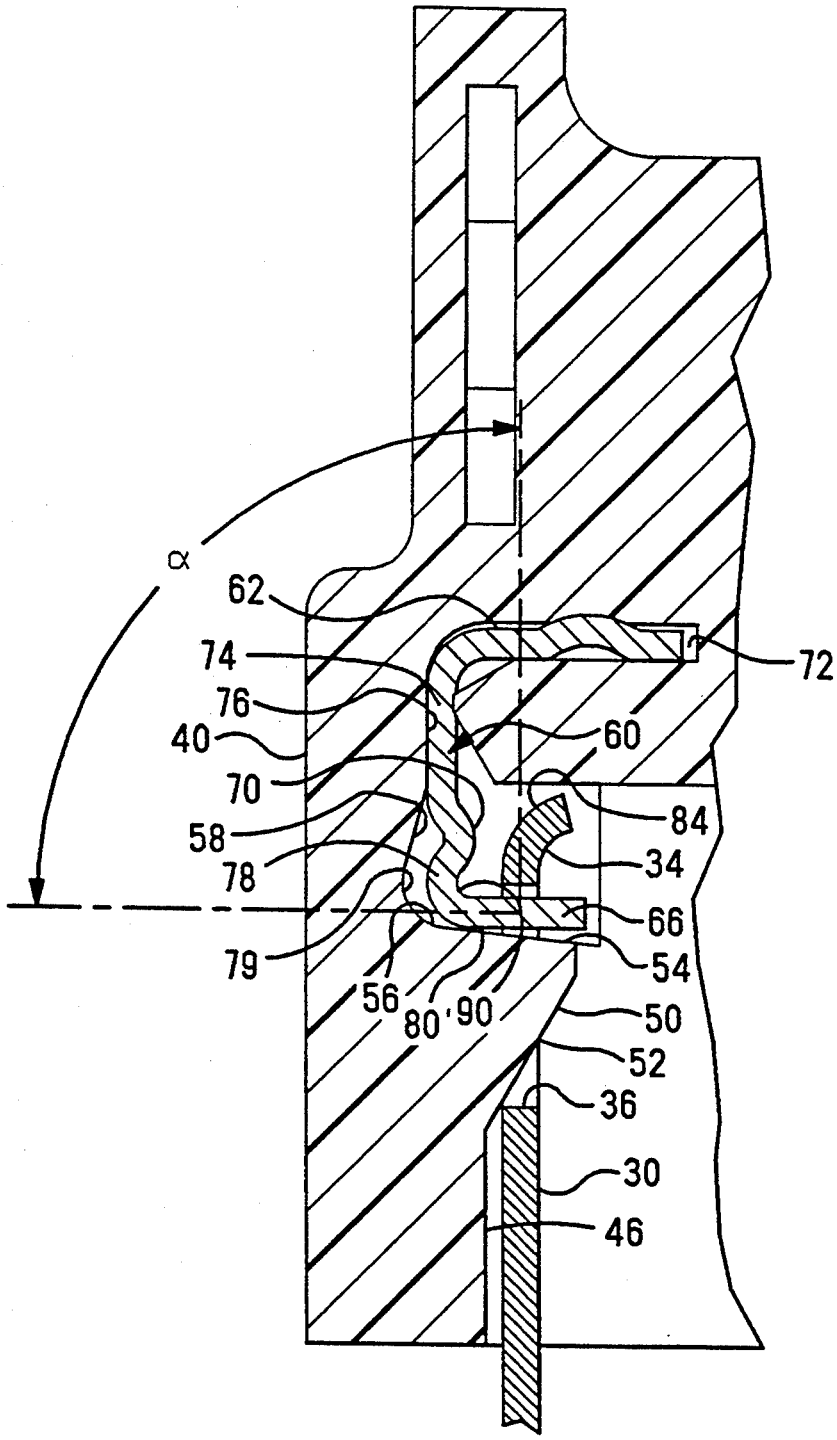
FIG. 4 is a partial, enlarged sectional view of one of a pair of latching members forming the latching system of this invention.

The receptacle 12, as best seen in FIG. 4, includes a lateral slot 72 of a length to receive, by press fitting, the first leg 65 of spring arm 60. With the spring arm 60 suitably received in slot 72, it will be noted that the upper portion 74 of intermediate leg 68 lies adjacent to wall 76, while the lower portion 78 is spaced from the wall 79 of recess 58. Note further that in a resiled condition, the second leg 66 projects laterally, i.e. right angle to the plane of the axis of the mated connectors, and preferably is spaced, even at the base 80, from the angled surface 54.

To mate the complementary connectors, the plug and receptacle, where the respective mating faces are in close proximity to one another, are coaxially pushed toward one another such that the latching arms 26 begin to ride up the ramp surfaces 52, along curved ends 84, where the arms flex inwardly. As the complementary connectors reach a fully mated position, the elongated slot means 36 becomes exposed to the projection 50 and second leg 66 of the spring arm where it resiles to a latching position overriding the projection and leg, see FIG. 4.

In order to ensure repeatable and reliable mating and unmating thereof, it is important that flexing of the respective metal latching members be limited to a level below the plastic range of the metal, that is, below a level of permanent deformation. This has been achieved herein by the proper selection of the metal for the spring members, but more importantly by the design thereof.

To effect a deliberate unmating of the connectors, the opposed buttons 23 may be manually squeezed to deflect inwardly the respective latching arms 60 and thereby free them from the leg 66. However, a significant feature of this invention is the ability or freedom to unmate the plug and receptacle without adversely affecting same through the application of a predetermined separating force, such as may occur by accident. The maximum separating force is required when the separation is along a coaxial direction. However, an accidental angular force may be applied to the connectors, and this force would likely be less than the design maximum. Continuing now with the unmating, as such predetermined force is applied, the second leg 66 flexes downwardly by the overriding action and contact with the slot 36 in the arm portion 30 urging the leg 66 towards the angled surface 54. The impact of the flexing is divided between the reverse bend portion 70 and the junction 90 of the leg portions 66, 68. This minimizes localized or concentrated bending to ensure that the plastic limit is not reached, and that the leg portion 66 will return to its normal laterally oriented position. In any case, as the leg portion 66 approaches the angled surface 54 under the predetermined force, where the angle thereof is related to such force, a critical release angle is reached. At this point, the latching arms portions 30, while under the predetermined force, begin to slide along the arm portion 66 in a lateral direction until freed therefrom and the connectors separated.

While the foregoing represents the preferred design and material to develop a self releasing latching system, when subjected to a predetermined separating force, there are a number of factors that can influence the final design parameters for such a system. The release angle, typically in the range of 4° to 10°, is totally dependent upon the coefficient of friction of the respective metal members, and surface roughness due to fabrication, such as in forming and shearing. Further, the predetermined force is dependent upon the geometry and material of the metal members. However, what can be stated, particularly with regard to FIGS. 1 and 4, the length of the latching arm 60 is relatively long compared to its distance of travel to the position of being released. That is, in the static position illustrated in FIG. 4, the angle $\alpha$ is 90°. As the latching arm 60 begins to pull the leg segment 66 downwardly, the angle $\alpha$ becomes less than 90°. Were the angle greater than 90°, such as might be found with a relatively short latching arm, the dynamic forces would tend to hold the latching arm rather than allowing it to slide and release.

Finally, with all the above factors considered, it is to be further understood that there is a relationship between the separating force and the critical angle. It was discovered that for a separating force of about 5 pounds per latch, with the design criteria and preferred material used, the critical angle was 5°, relative to a plane traverse to the connector axis, and that the angle $\alpha$ was 87.5°.

We claim:

1. A latching system for a pair of intermatable electrical connectors, where said connectors are in latching relationship during periods of operability, and may be unlatched by exerting a maximum predetermined separating force on the respective connectors, said system comprising a first of said electrical connectors having a pair of flexible arms, each with a free end, projecting axially therefrom, where the free ends of said arms include slot means for engaging complementary arms within the second of said electrical connectors, said second electrical connector having an insulative body with projections, one of said projections including a forward ramp surface against which said respective flexible arms initially ride to effect mating of said connectors, and a rearward surface slightly angled from a base toward said ramp surface, a metal spring arm mounted within said second electrical connector in close proximity to said base of said rearward surface, said metal spring arm having a first fixed portion within said second electrical connector and a second free portion adapted to engage said slot means whereby in the mated condition of said electrical connectors said spring arm engages said slot means, and to effect unmating a maximum predetermined separating force may be applied therebetween causing said spring arm to flex to a position near said rearward surface at a critical release angle to thereby release said free end from a respective said spring arm.

2. The latching system according to claim 1, wherein said spring arm is U-shaped having a first fixed leg within said second electrical connector and a second free leg adapted to engage said slot means.

3. The latching system according to claim 2, wherein said legs are substantially parallel having an intermediate leg therebetween.

4. The latching system according to claim 3, wherein said second free leg and said intermediate leg may be flexed during unmating of said electrical connectors.

5. The latching system according to claim 4, wherein said intermediate leg includes a reverse bend portion to facilitate flexing of said spring arm below the limit of permanent deformation.

6. The latching system according to claim 1, wherein said rearward surface is angled between 4° to about 10° from a plane of said flexible arm in a resiled condition.

7. The latching system according to claim 2, wherein said rearward surface may act as a stop to prevent overstressing said second free leg.

8. The latching system according to claim 1, wherein a pair of opposing members, each in an operable position to contact a said flexible arm, are provided to effect manual disengagement of said electrical connectors.

9. The latching system according to claim 6, wherein in the resiled position of said flexible arm the angle between said free end and a corresponding spring arm engaging portion is 90°, and that upon the application of said separating force said release angle is less than 90°.

* * * * *